US008075163B2

(12) United States Patent
Xiao et al.

(10) Patent No.: US 8,075,163 B2
(45) Date of Patent: Dec. 13, 2011

(54) ILLUMINATION LAMP AND ROTATABLE LIGHT-EMITTING MODULE THEREOF

(75) Inventors: Xin-Jian Xiao, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 300 days.

(21) Appl. No.: 12/504,678

(22) Filed: Jul. 17, 2009

(65) Prior Publication Data

US 2010/0157570 A1 Jun. 24, 2010

(30) Foreign Application Priority Data

Dec. 18, 2008 (CN) ..... 2008 1 0306361

(51) Int. Cl.
*F21V 21/30* (2006.01)

(52) U.S. Cl. ..... 362/287; 362/294; 362/269; 362/288; 362/249.02

(58) Field of Classification Search ..... 362/249.02, 362/294, 218, 285–288, 249.03, 220, 427, 362/269

See application file for complete search history.

(56) References Cited

U.S. PATENT DOCUMENTS

| | | | | |
|---|---|---|---|---|
| 6,472,823 | B2 * | 10/2002 | Yen | 315/112 |
| 7,311,423 | B2 * | 12/2007 | Frecska et al. | 362/372 |
| 7,572,027 | B2 * | 8/2009 | Zampini et al. | 362/225 |
| 7,802,903 | B1 * | 9/2010 | Wray | 362/249.02 |
| 2009/0310354 | A1 * | 12/2009 | Zampini et al. | 362/235 |

FOREIGN PATENT DOCUMENTS

CN 201014270 Y 1/2008

* cited by examiner

*Primary Examiner* — Robert May
(74) *Attorney, Agent, or Firm* — Altis Law Group, Inc.

(57) ABSTRACT

An illumination lamp includes a mounting frame and at least a rotatable light-emitting module. The at least a rotatable light-emitting module includes at least one bracket with one end securely mounted on the mounting frame, a heat sink being pivotally connected with the other end of the at least one bracket, and a light source mounted on the heat sink.

12 Claims, 6 Drawing Sheets

ILLUMINATION LAMP AND ROTATABLE LIGHT-EMITTING MODULE THEREOF

BACKGROUND

1. Technical Field

The present invention relates generally to an illumination lamp, and more particularly to an illumination lamp having rotatable light-emitting modules so that the direction of light from the illumination lamp can be conveniently adjusted.

2. Description of Related Art

An illumination lamp is widely used in various fields. For example, an illumination lamp has been widely used for illumination purpose. However, the illumination lamp generally cannot be adjusted to change the direction of light from the illumination lamp after assembly. Thus, the illumination lamp sometimes cannot meet the requirement of users.

Therefore, it is desirable to provide an illumination lamp to overcome the above-mentioned shortcoming.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
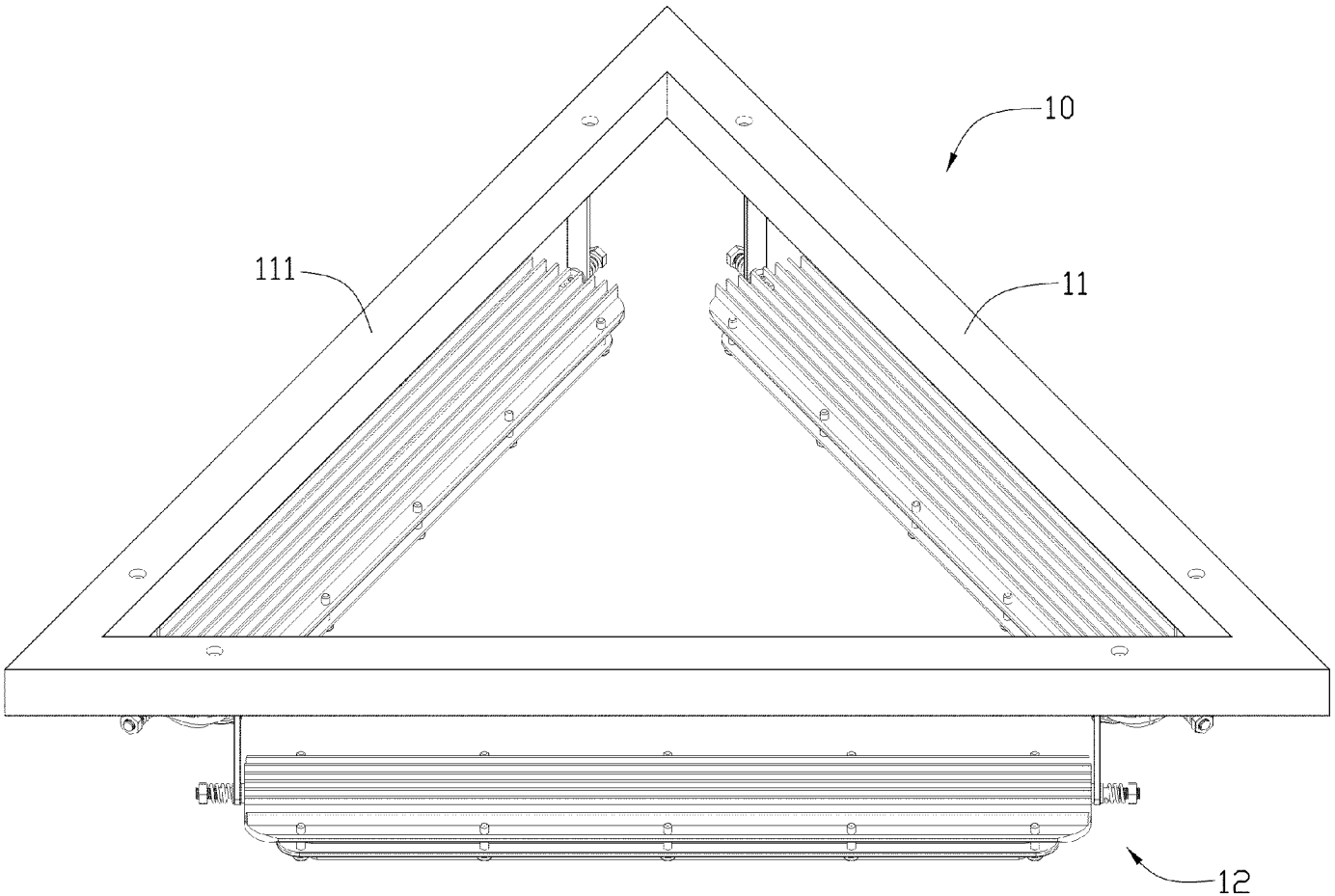
FIG. 1 an isometric view of an illumination lamp according to a first embodiment of the present invention.
Figure 2:
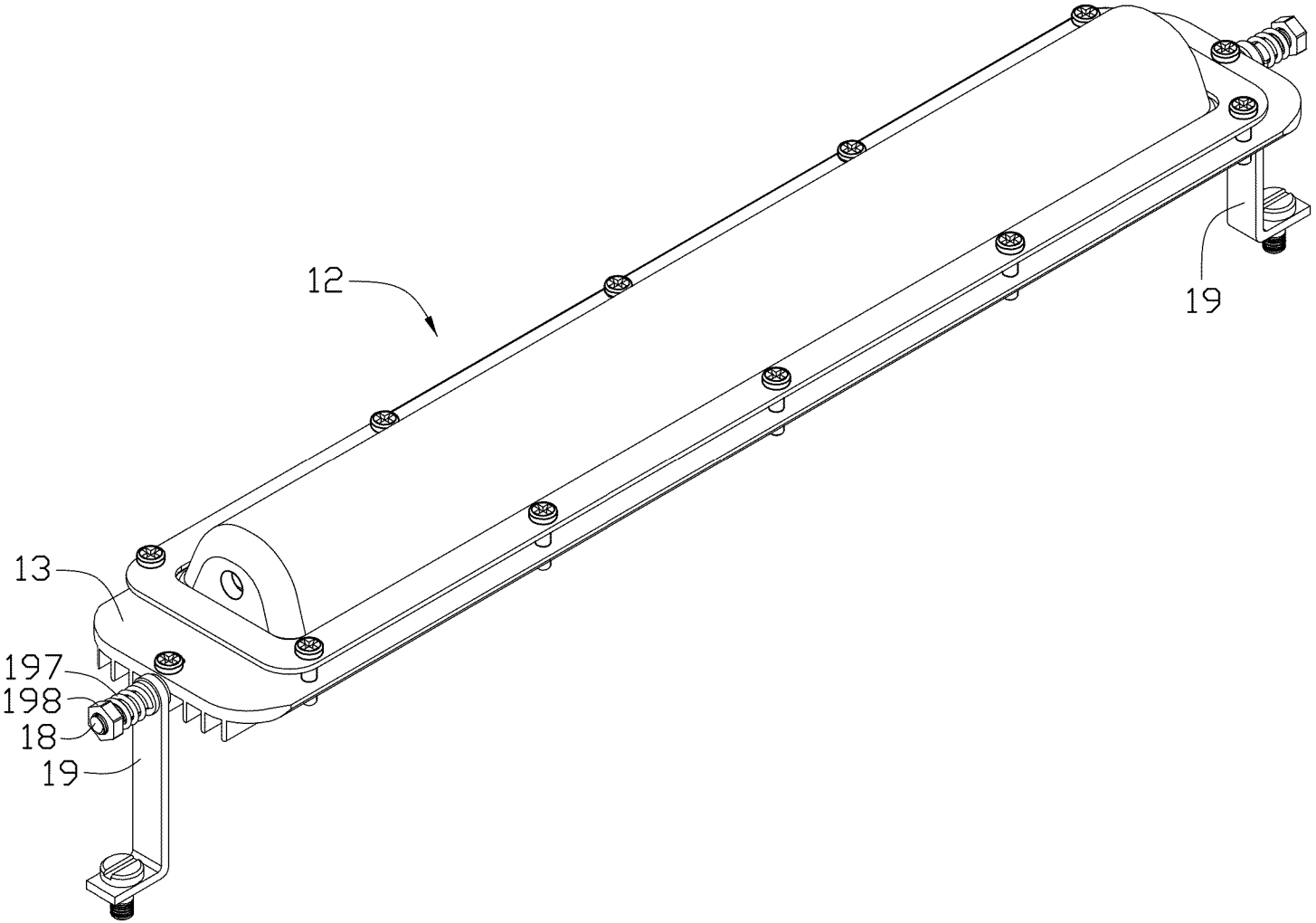
FIG. 2 is an isometric view of a rotatable light-emitting module of the illumination lamp of FIG. 1.
Figure 3:
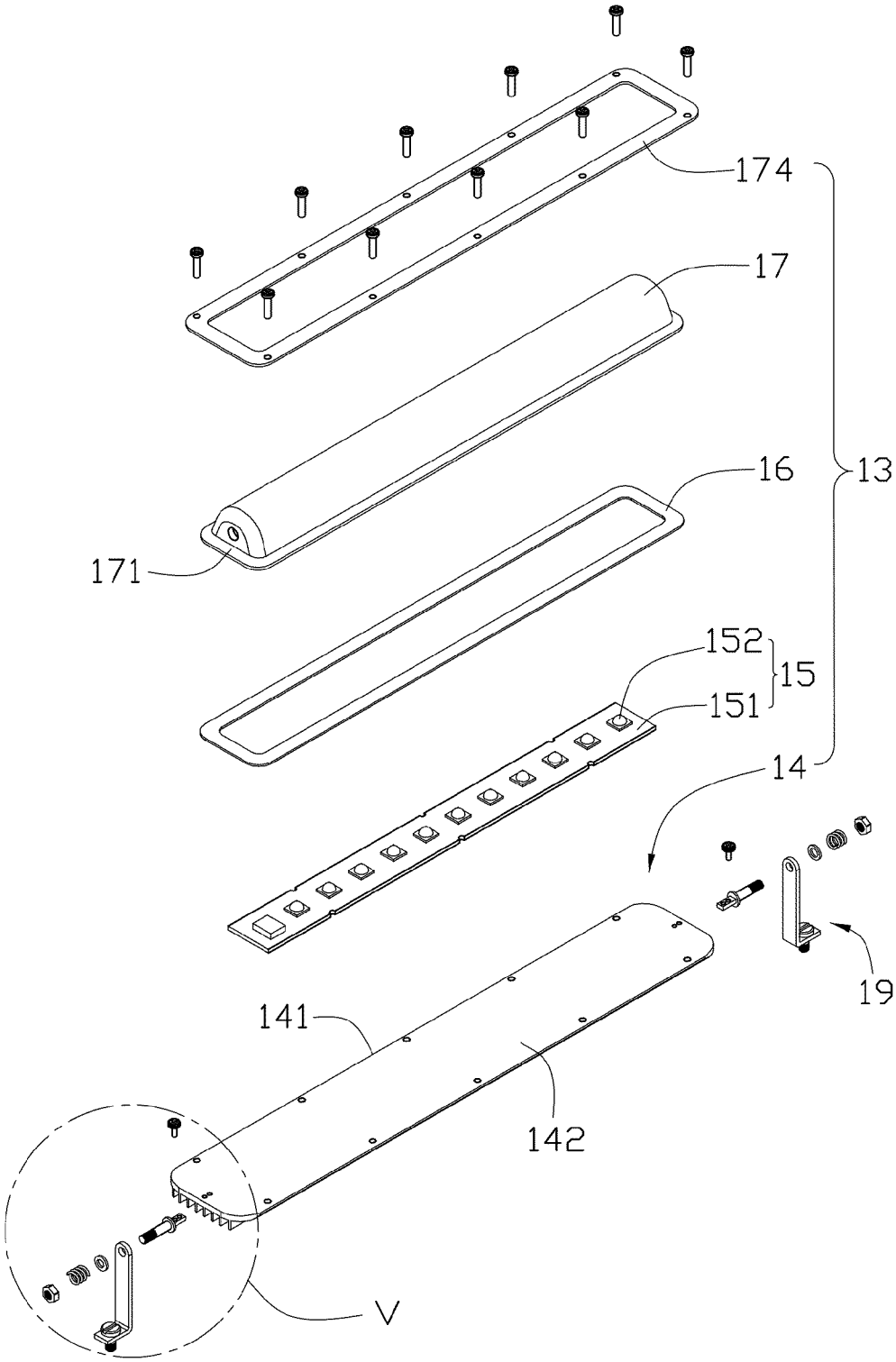
FIG. 3 is an exploded view of the rotatable light-emitting module of the illumination lamp of FIG. 2, viewed from a bottom aspect.
Figure 4:
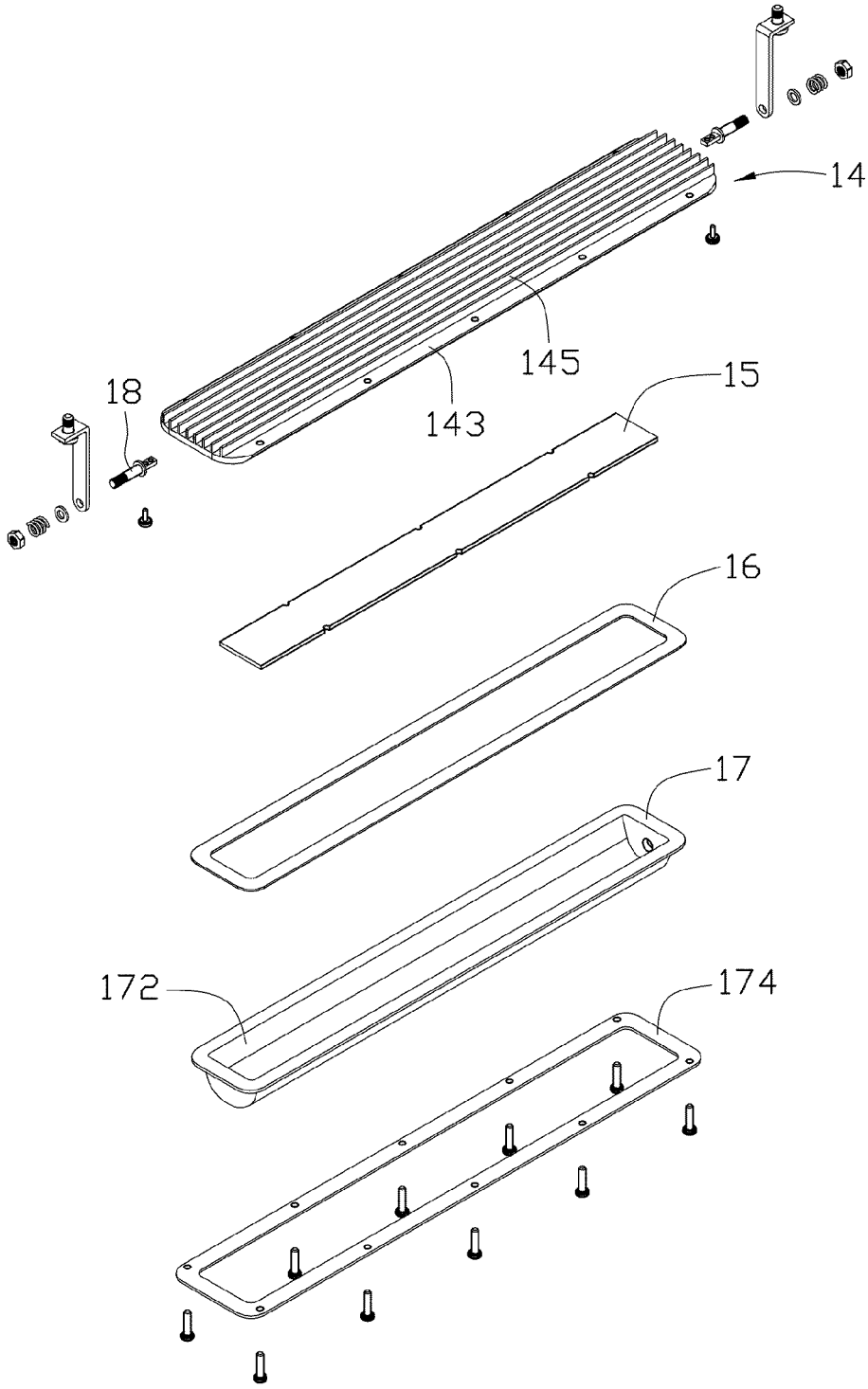
FIG. 4 is a view similar to FIG. 3, viewed from a top aspect.
Figure 5:
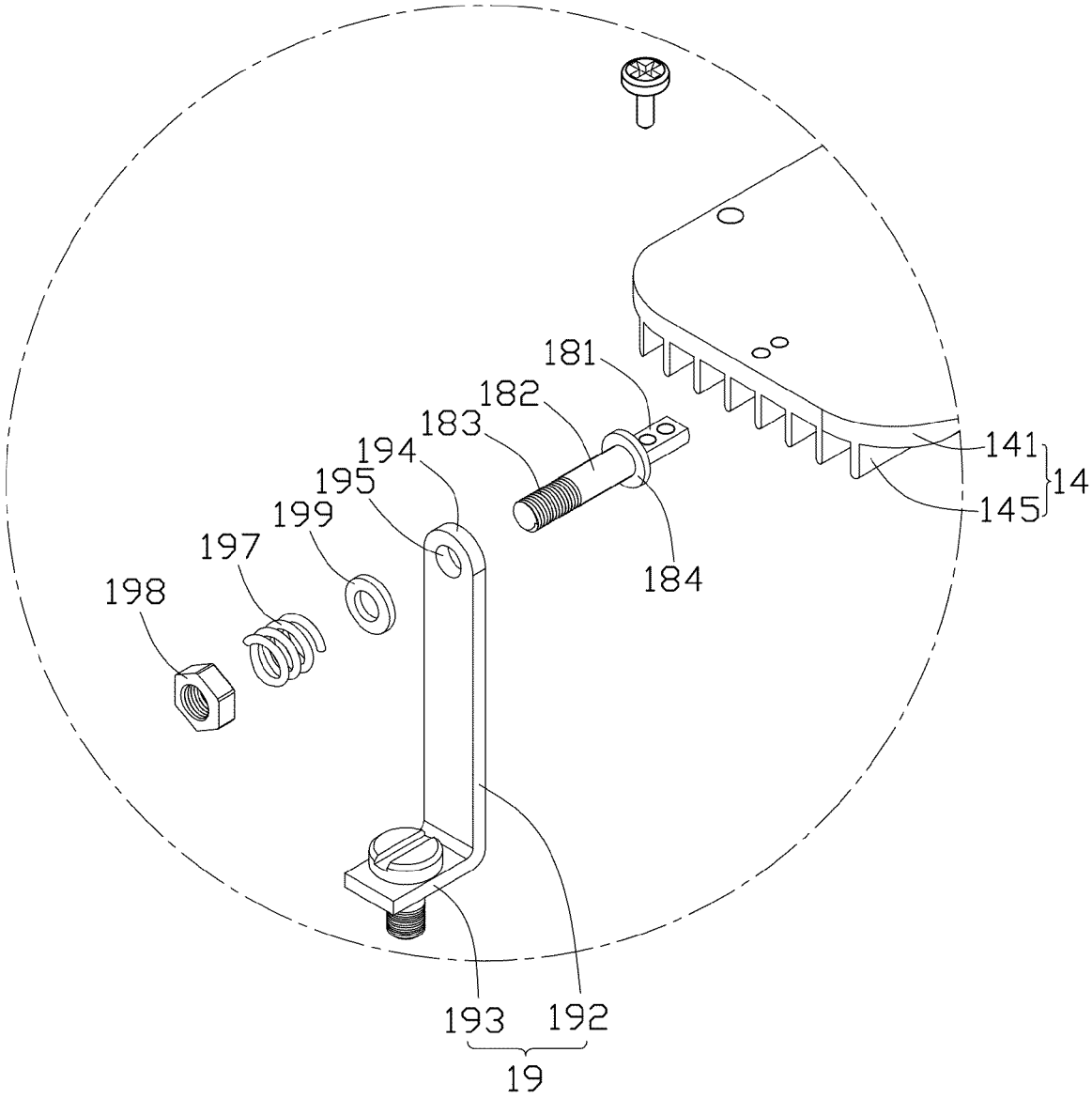
FIG. 5 is an enlarged view of a circled portion V of FIG. 3.

Referring to FIG. 1, an illumination lamp 10 according to an exemplary embodiment of the present invention includes a mounting frame 11 and three rotatable light-emitting modules 12 mounted to the mounting frame 11. The mounting frame 11 is equilateral triangle-shaped and includes three mounting arms 111 connecting with each other. The three rotatable light-emitting modules 12 are suspended under the three mounting arms 111, respectively.

Referring to FIGS. 2-5, the rotatable light-emitting module 12 includes a light-emitting unit 13, two L-shaped brackets 19, two poles 18, two springs 197 and two nuts 198. The two brackets 19 are symmetrically disposed at two opposite ends of the light-emitting unit 13. The light-emitting unit 13 is pivotally connected with the two brackets 19.

The light-emitting unit 13 is disposed under the mounting frame 11 and includes a heat sink 14, a light source 15, a sealing member 16, a transparent cover 17 and an engaging member 174. The heat sink 14 includes a base plate 141 and a plurality of fins 145 formed on the base plate 141 and facing the mounting frame 11. The base plate 141 has a heat absorbing surface 142 at a bottom side thereof and a heat dissipating surface 143 opposite to the heat absorbing surface 142. The plurality of fins 145 extend from the heat dissipating surface 143 of the heat sink 14 and are spaced from each other.

The light source 15 includes a printed circuit board 151 attached to the heat absorbing surface 142 of the heat sink 14 and a plurality of light emitting diodes 152 (LEDs) disposed on the printed circuit board 151 and spaced from each other.

The transparent cover 17 has an engaging flange 171 extending outwardly from an outer peripheral edge thereof and defines a recess 172 therein for receiving the light source 15. The transparent cover 17 is disposed on the base plate 141, whereby the transparent cover 17 and the base plate 141 cooperatively define a receiving chamber for receiving the light source 15 therein. The sealing member 16 defines a rectangle-shaped through hole therein. The sealing member 16 is sandwiched between the transparent cover 17 and the base plate 141 for preventing dust and water from entering the receiving chamber in which the light source 15 is received.

The engaging member 174 is disposed on the engaging flange 171 of the transparent cover 17. The engaging member 174, the transparent cover 17 and the sealing member 16 are together fixed on the base plate 141 of the heat sink 14 via screws (not labeled).

The bracket 19 includes a vertical section 192 and a lateral section 193 perpendicular to the vertical section 192. A free end 194 of the vertical section 192 defines a through hole 195.

The pole 18 includes a flat fixing section 181, a column-shaped rotating section 182 and a thread section 183. The fixing section 181 and the thread section 183 are disposed at two opposite ends of the pole 18, and the rotating section 182 is disposed between the fixing section 181 and the thread section 183. A flange 184 is formed at a joint between the rotating section 182 and the fixing section 181 and has a diameter larger than a diameter of the rotating section 182 and a width of the fixing section 181.

The lateral section 193 of the bracket 19 is fixedly mounted on the mounting arm 111 of the mounting frame 11 via a screw (not labeled). The thread section 183 and the rotating section 182 successively extend through the through hole 195 of the vertical section 192 of the bracket 19 until the flange 184 resists on the vertical section 192 of the bracket 19. The nut 198 is engaged with the thread section 183 of the pole 18. The spring 197 is disposed around the pole 18 and is compressively sandwiched between the nut 198 and the vertical section 192 of the bracket 19. Preferably, a gasket 199 is sandwiched between the spring 197 and the vertical section 192 of the bracket 19. The fixing section 181 of the pole 18 is fixed on the heat dissipating surface 143 of the heat sink 14 via a screw (not labeled) and disposed between two adjacent fins 145.

The spring 197 is compressed for providing an axial reactive force on the vertical section 192 of the bracket 19, whereby the vertical section 192 of the bracket 19 is firmly attached to the flange 184 of the pole 18 and a static friction between the pole 18 and the bracket 19 offers resistance to relative motion of the light-emitting unit 13 to the bracket 19 and the mounting arm 11 of the frame 10. When an external force exceeding the static friction is applied on the light-emitting unit 13, the light-emitting unit 13 can be rotated relative to the bracket 19. Without the external force, the light-emitting unit 13 remains at a stationary position relative to the bracket 19.

Since the light-emitting unit 13 is pivotally connected with the bracket 19, a direction of light from each of the plurality of the light-emitting units 13 can be independently adjusted so that the lightening direction of the illumination lamp 10 can be conveniently adjusted. Thus, a distribution of luminous intensity of the illumination lamp 10 can be conveniently adjusted to satisfy various luminous requirements without reassembling the whole illumination lamp 10.

Figure 6:
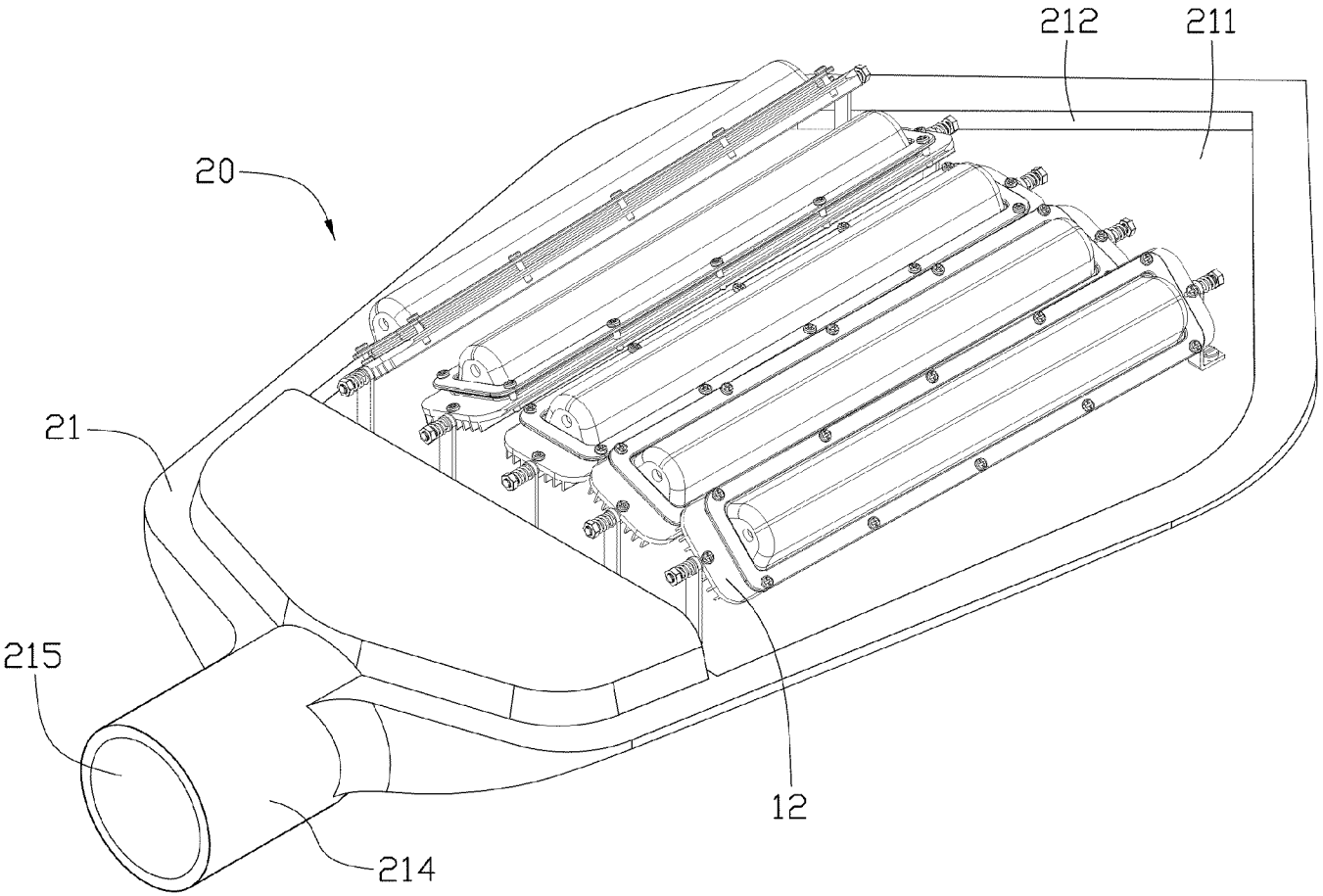
FIG. 6 an isometric view of an illumination lamp according to a second embodiment of the present invention.

FIG. 6 shows an alternative embodiment of the illumination lamp. In this alternative embodiment, the illumination lamp 20 includes a mounting frame 21 and a plurality of rotatable light-emitting modules 12 mounted to the mounting frame 21. The mounting frame 21 includes a bottom wall 211 and a side wall 212 extending downwardly from an outer peripheral edge of the bottom wall 211. The plurality of rotatable light emitting modules 12 are evenly mounted on the bottom wall 211 of the mounting frame 21 and surrounded by the side wall 212. The heat sink 14 of each of the plurality of rotatable light-emitting modules 12 faces the bottom wall 211. A fixing head 214 is formed at a left side of the mounting frame 21 and a fixing hole 215 is defined in the fixing head 214, whereby the illumination lamp 20 can be coupled to a street lamp post as a street lamp.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A rotatable light-emitting module for a lamp comprising:

at least one bracket for securing to a stationary mounting frame of the lamp;

a heat sink being pivotally connected with the at least one bracket, a friction existed between the heat sink and the at least one bracket whereby the heat sink is kept at a desired orientation when no force larger than the friction is applied to the heat sink;

a light source mounted on the heat sink;

a pole with one end thereof fixed on the heat sink, the at least one bracket defining a through hole therein, the other end of the pole extending through the through hole of the at least one bracket and mounted to the at least one bracket, the friction between the heat sink and the at least one bracket being existed between the pole and the at least one bracket; and a spring and a nut, the pole having a fixing section, a rotating section and a thread section, the fixing section and the thread section being disposed at two opposite ends of the pole with the rotating section located between the fixing section and the thread section, the fixing section being fixed with the heat sink, the rotating section being received in the through hole of the at least one bracket, the nut being engaged with the thread section, the spring being disposed around the pole and compressively sandwiched between the nut and the at least one bracket.

2. The rotatable light-emitting module as claimed in claim 1, wherein the at least one bracket includes a first bracket and a second bracket, and the first and the second brackets are symmetrically disposed at two opposite ends of the heat sink.

3. The rotatable light-emitting module as claimed in claim 1 further comprising a gasket sandwiched between the spring and the at least one bracket, a flange being formed at a joint between the fixing section and the rotating section, the at least one bracket being sandwiched between the flange and the gasket, the friction existed between the at least one bracket and the pole being existed between the flange and the at least one bracket.

4. The rotatable light-emitting module as claimed in claim 1, wherein the heat sink includes a base plate and a plurality of fins, the base plate having a heat absorbing surface and a heat dissipating surface at two opposite sides thereof, the plurality of fins being formed on the heat dissipating surface, the light source being located on the heat absorbing surface.

5. The rotatable light-emitting module as claimed in claim 4, wherein the fixing section of the pole is fixed with the base plate of the heat sink.

6. The rotatable light-emitting module as claimed in claim 1, wherein the light source comprises a plurality of LEDs.

7. An illumination lamp comprising:

a mounting frame;

at least a rotatable light-emitting module comprising:

at least one bracket with one end securely mounted on the mounting frame;

a heat sink being pivotally connected with another end of the at least one bracket;

a light source mounted on the heat sink;

a pole with one end thereof fixed on the heat sink, the at least one bracket defining a through hole therein, the other end of the pole extending through the through hole of the at least one bracket and mounted to the at least one bracket under a friction existed between the pole and the at least one bracket; and a spring and a nut, the pole having a fixing section, a rotating section and a thread section, the fixing section and the thread section being disposed at two opposite ends of the pole with the rotating section located between the fixing section and the thread section, the fixing section being fixed with the heat sink, the rotating section being received in the through hole of the at least one bracket, the nut being engaged with the thread section, the spring being disposed around the pole and compressively sandwiched between the nut and the at least one bracket.

8. The illumination lamp as claimed in claim 7, wherein the at least one bracket includes a first bracket and a second bracket, and the first and the second brackets are symmetrically disposed at two opposite ends of the heat sink.

9. The illumination lamp as claimed in claim 7 further comprising a gasket sandwiched between the spring and the at least one bracket, a flange being formed at a joint between the fixing section and the rotating section, the at least one bracket being sandwiched between the flange and the gasket, the friction existed between the at least one bracket and the pole being existed between the flange and the at least one bracket, the friction inhibiting a relative motion between the pole and the at least one bracket.

10. The illumination lamp as claimed in claim 7, wherein the light source comprises a plurality of LEDs.

11. The illumination lamp as claimed in claim 7, wherein the mounting frame is equilateral triangle-shaped and includes three mounting arms connecting with each other, the at least a rotatable light-emitting modules having three rotatable light-emitting modules, and the three rotatable light-emitting modules being suspended under the three mounting arms, respectively.

12. The illumination lamp as claimed in claim 7, wherein the mounting frame includes a bottom wall and a side wall extending downwardly from an outer peripheral edge of the bottom wall, the at least a rotatable light-emitting modules being disposed on the bottom wall and surrounded by the side wall.

* * * * *